US005567117A

United States Patent [19]

Gunn et al.

[11] Patent Number: 5,567,117

[45] Date of Patent: Oct. 22, 1996

[54] RECIRCULATION FAN PORTABLE MOUNTING APPARATUS

[76] Inventors: Doyle M. Gunn, 2225 Hulman St., Terre Haute, Ind. 47803; Larry A. Ramsey, R.R. #1 Box 268B, Rockville, Ind. 47872-9768

[21] Appl. No.: 538,383

[22] Filed: Oct. 3, 1995

[51] Int. Cl.[6] ..... F04D 29/64

[52] U.S. Cl. ..... 416/244 R; 248/222.52; 248/343

[58] Field of Search ..... 416/5, 244 R, 416/246; 248/61, 222.52, 228.1, 340, 342, 343, 344

[56] References Cited

U.S. PATENT DOCUMENTS 4,221,355 9/1980 Hoop ..... 248/340

5,242,269 9/1993 Chang .

FOREIGN PATENT DOCUMENTS 58-101292 6/1983 Japan ..... 416/5

2149013 6/1985 United Kingdom ..... 416/5

*Primary Examiner*—James Larson

*Attorney, Agent, or Firm*—John D. Gugliotta

[57] ABSTRACT

A recirculation fan portable mounting apparatus is disclosed comprising a generally flat mounting plate having an upper surface and a lower surface. Protruding above the upper surface are a pair of oppositely mounted grasping hooks extending upward there from. The central aperture in the middle of the mounting plate allows for passage of electrical cords through the mounting plate. The eye bolts are then threaded to the under side of the plate at a central location as to eventually impinge a support member between each eye bolt and the tongue portion of the protruded mounting clamps.

4 Claims, 4 Drawing Sheets

RECIRCULATION FAN PORTABLE MOUNTING APPARATUS

BACKGROUND OF THE INVENTION

1. Field of the Invention

The present invention relates generally to mounting brackets and, more particularly, to a mounting apparatus for portably mounting an overhead circulation fan to a tension bar, recreational vehicle awning, or the like.

2. Description of the Related Art

In the related art, many forms of mounting devices are known. For example, in U.S. Pat. No. 5,242,269 issued in the name of Chang, a mounting device for a ceiling fan is disclosed. The mounting device disclosed in the Chang reference includes a plate having a protrusion formed in a middle portion and a pair of flanges oppositely formed beside the protrusion with said flanges being utilized to firmly and securely mount a ceiling fan to a standard electrical ceiling fixture. Such a device, however, cannot be adapted for use with portable mountings or temporary mounting on a mounting rod.

Also, in U.S. Pat. No. 5,044,582, issued in the name of Walters, a ceiling fan support is disclosed for supporting a fan in a hole through a ceiling. The support comprises telescoping sections and is insertible through a hole in the ceiling, and has teethed braces at each end adapted to be situated against a pair of spaced joists in the ceiling on each side of the hole. As such a device is ineffective when utilized with a temporary or portable ventilation fan.

Also known is U.S. Pat. No. Des. 297,859 issued in the name of Jiang for a ceiling fan support or similar article showing an ornamental design for ceiling fan support comprising essentially a decorative inverted pedestal for use with a standard ceiling fan when mounted to a standard ceiling application.

Similarly, U.S. Pat. No. 5,292,228 issued in the name of Dye discloses a ceiling fan support comprising a complex arrangements of support bracing and inverted bowls in which a decorative hanging ceiling fan with light is created essentially for adding aesthetically pleasing appearance and not for use in portable or temporary ventilation fans.

Finally known is U.S. Pat. No. Des. 335,529 issued in the name of San-Jou for a fan for use in an automobile wherein an ornamental design for such a fan is disclosed. It is felt however, that such a fan is not pertinent to the present disclosure.

Consequently, a need has long been felt for providing an apparatus which allows for the mounting of a ceiling fan to a recreational vehicle awning or tension bar for circular support bar for use to improve air circulation in a temporary or portable manner.

SUMMARY OF THE INVENTION

It is therefore an object of the present invention to provide an improved mounting apparatus with a portable or temporary mounting of an overhead ceiling fan.

It is yet another object of the present invention to provide an improved mounting apparatus which can be adapted to mount an overhead ceiling fan in a portable and temporary manner to the awning of a recreational vehicle.

It is yet another object of the present invention to provide a mounting apparatus for an overhead ceiling fan which can be adapted for temporary and portable installation of overhead ceiling fans using temporary support structures such as a tension bar.

It is a feature of the present invention to provide a ceiling fan mounting apparatus which mounts under a recreational vehicle awning to provide overhead ventilation under such awnings.

In accordance with the ;preferred embodiment of the present invention a ceiling fan mounting apparatus is disclosed comprising a generally flat mounting plate having an upper surface and a lower surface. Protruding above the upper surface are a pair of oppositely mounted grasping hooks extending upward therefrom. The central aperture in the middle of the mounting plate allows for passage of electrical cords through the mounting plate. The eye bolts are then threaded to the under side of the plate at a central location as to eventually impinge a support member between each eye bolt and the tongue portion of the protruded mounting clamps.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
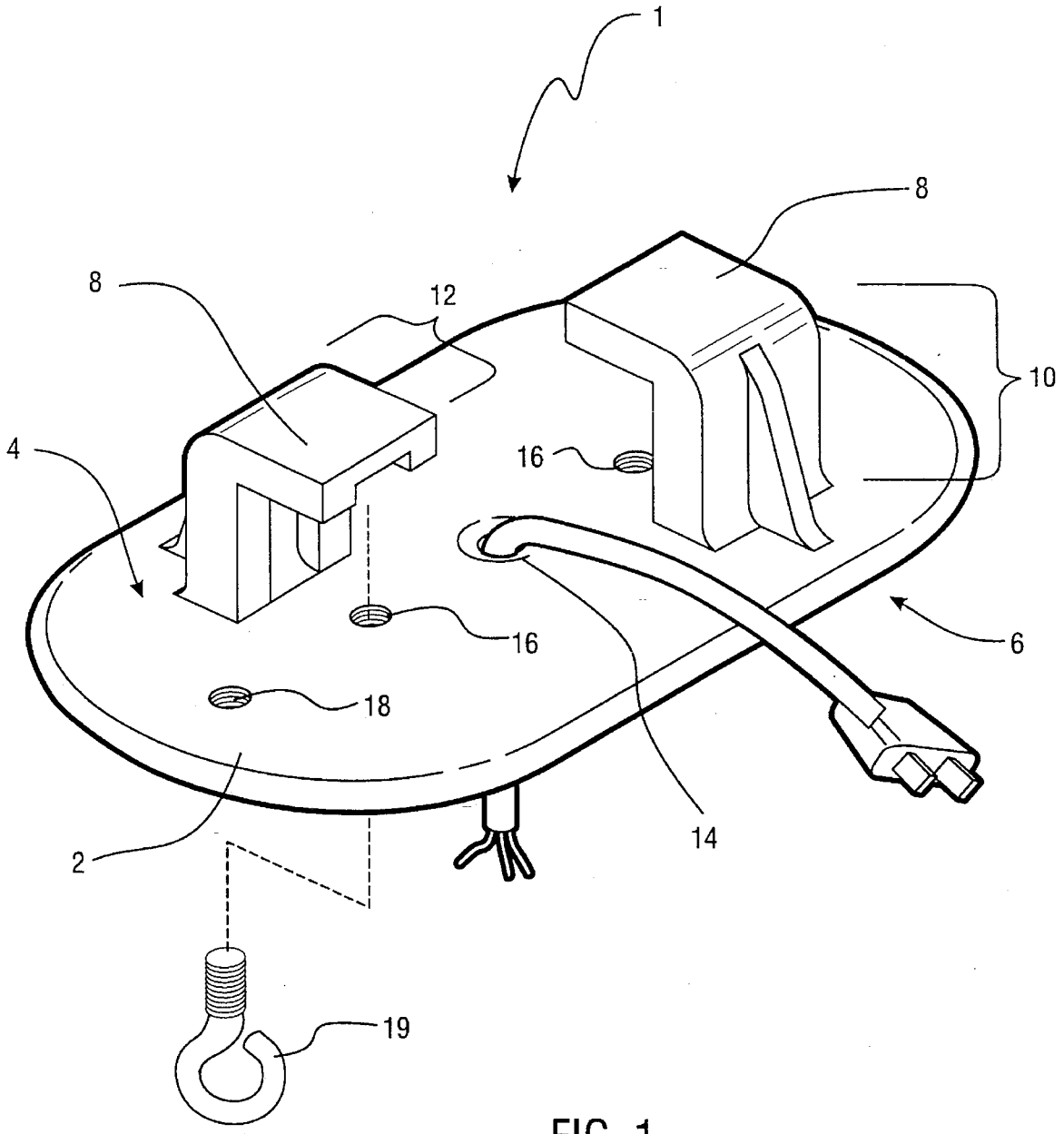
FIG. 1 is a perspective view depicting a mounting bracket for use in the ceiling fan mounting system according to the preferred embodiment of the present invention.

Referring now to FIG. 1, a recirculation fan portable mounting apparatus 1 is shown, according to the present invention, comprising a generally flat mounting plate 2 having an upper surface 4 and a lower surface 6, and a pair of oppositely and offset mounted grasping hooks 8 protruding above the upper surface 4. Each grasping hook 8 has a vertical wall 10 extending upward, and a horizontal tongue 12 attached perpendicularly to the top of the vertical wall 10 and directed inward toward the centerline of the mounting plate 2. At the center of the mounting plate 2 is a central aperture 14 to allow for passage of electrical cords through the mounting plate 2. A bolt hole 16 also penetrates the mounting plate 2 at a location directly beneath each horizontal tongue 12. In its preferred embodiment it is envisioned that a pair of standard eye-bolts 19 are threaded into each bolt hole 16 at the lower surface 6. In addition, it is currently envisioned that the preferred embodiment would contain a number of alternate mounting holes 18 spaced along the mounting plate 2 as intervals corresponding with various standard mounting distances currently utilized through the lighting industries.

Figure 2:
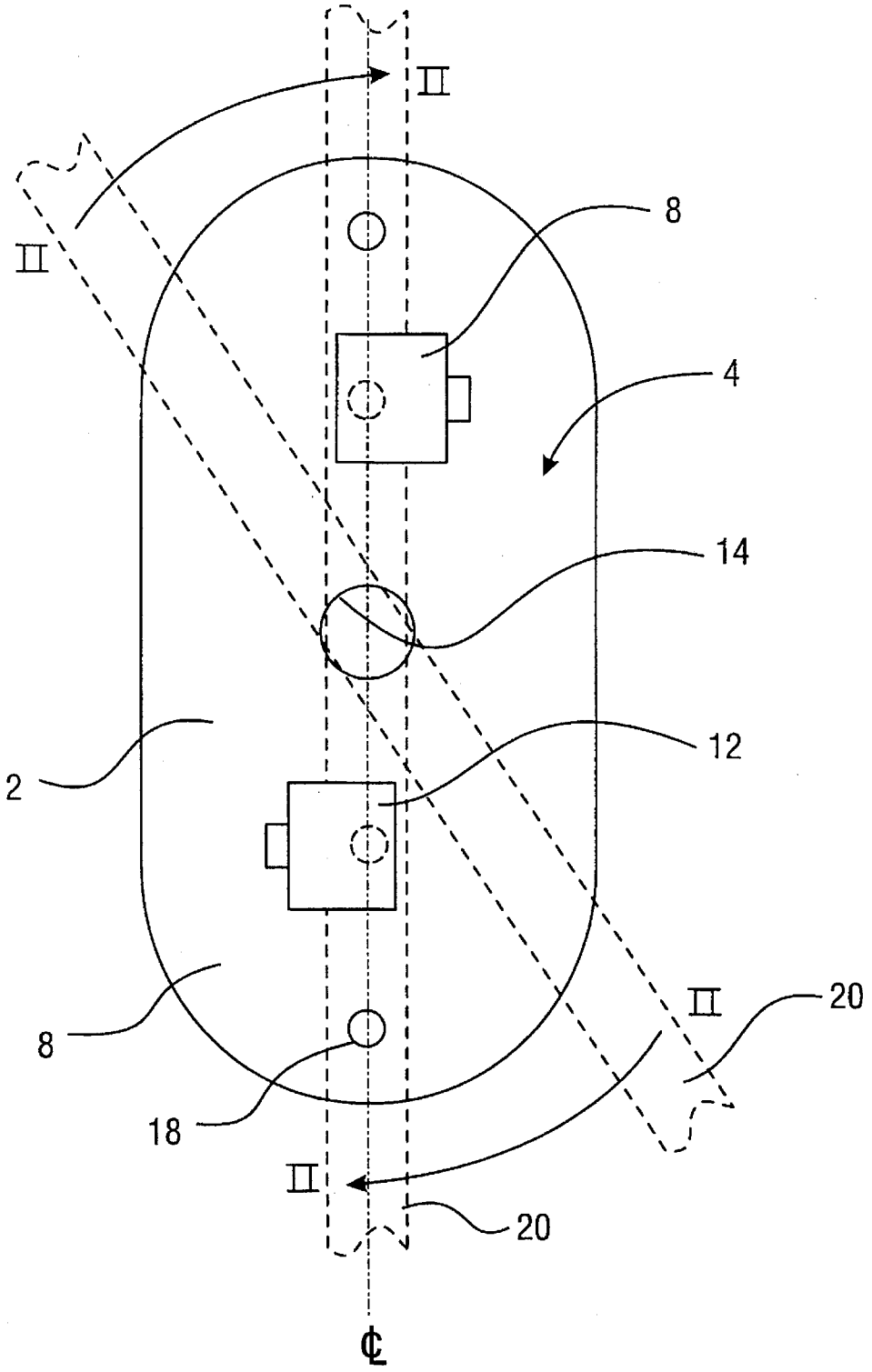
FIG. 2 is a top view thereof.

Referring to FIG. 2, the relationship between the central aperture 14 and grasping hooks 8 to the centerline of the mounting plate 2 is shown. As is seen, each grasping hook 8 is offset in an opposite direction from the centerline of the mounting plate 2. In this configuration, a support member 20, such as the awning frame of a recreational vehicle or other standard and readily available tension-rods can be fit between the upper surface 4 and the tongue 12 by twisting the mounting plate 2 in the direction indicated by arcs II—II. Then, the eye-bolts 19 can be threaded into each bolt hole 16 at the lower surface 6 such as to impinge the support member 20 between the each eye bolt 19 and its respective tongue 12.

Figure 3:
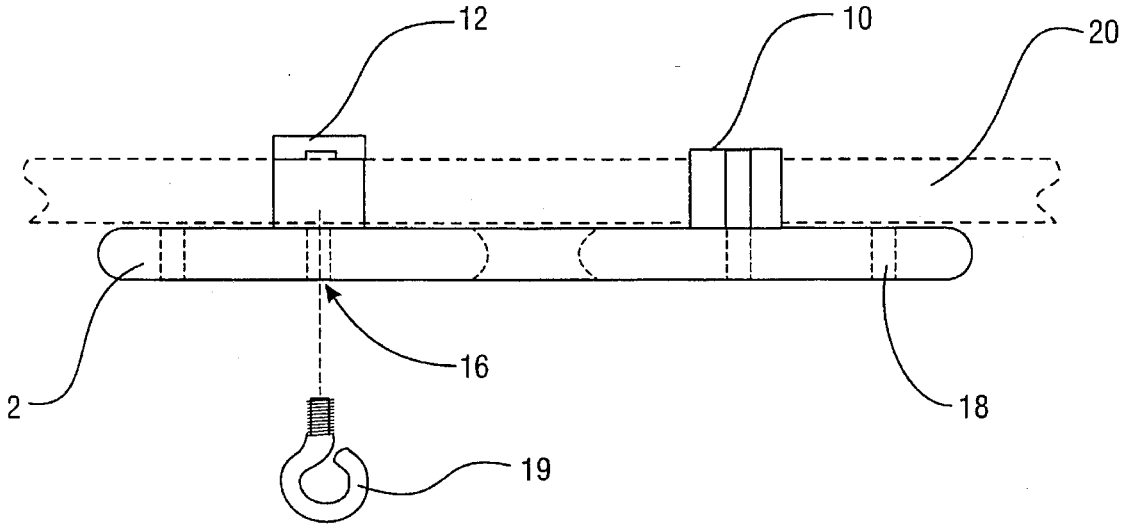
FIG. 3 is a side view thereof.

FIG. 3 also shows the mounting configuration in FIG. 2. In addition, the impingement of the eye-bolt 19 through the bolt hole 16 clearly demonstrates that the mounting plate 2 can be firmly and temporarily mounted to a support member 20. Vertically, the support member is impinged between the eye-bolt 19 and the tongue 12. Horizontally, the vertical walls 10 lock the mounting plate 2 in place. Rotational inertia imparted by a rotating ceiling fan will provide additional impetus for the ceiling fan to remain steadied in the horizontal plane.

2. Operation of the Preferred Embodiment

Figure 4:
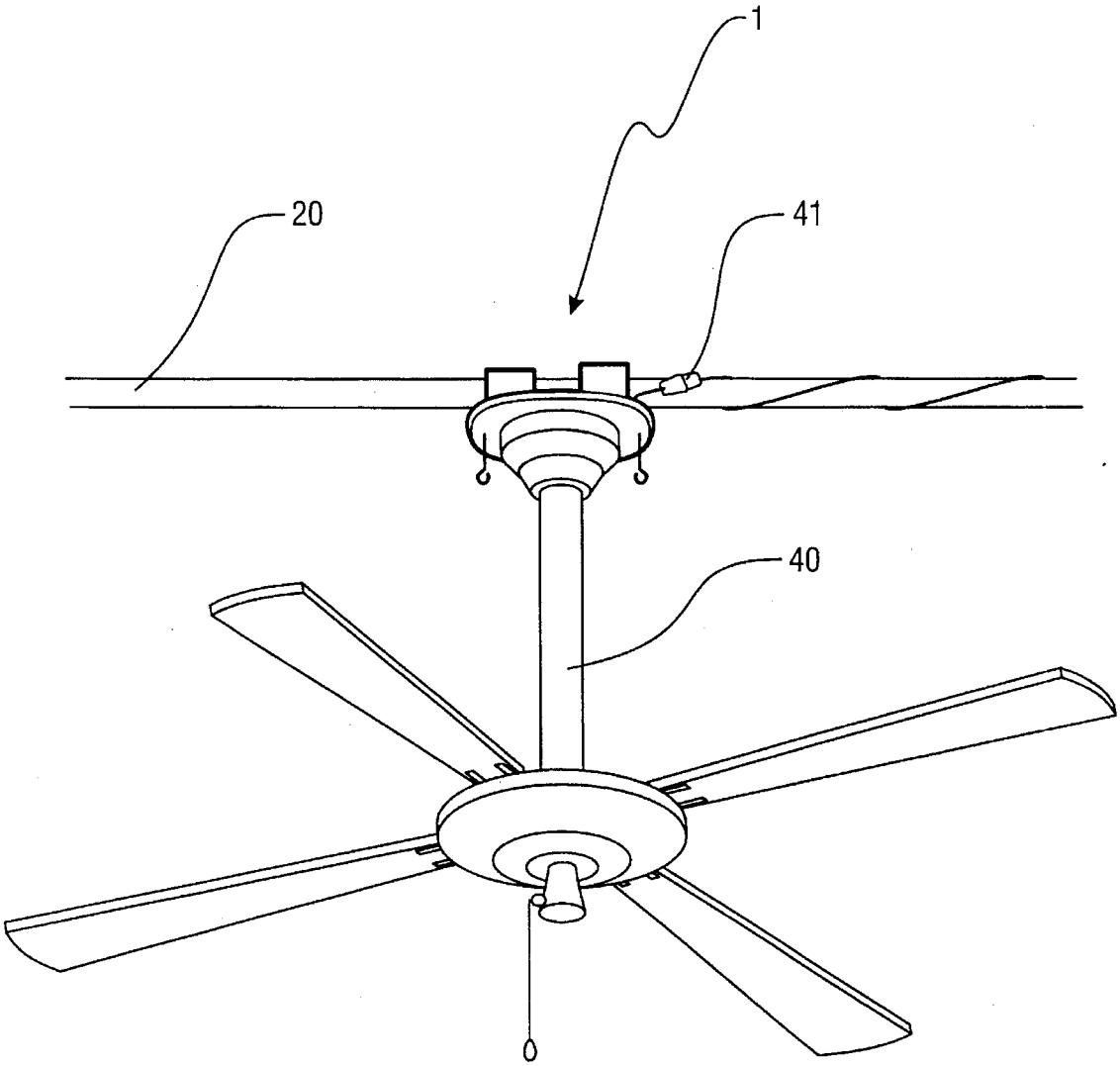
FIG. 4 is a perspective view of the preferred embodiment of the present invention utilized in conjunction with the ceiling fan mounted beneath a support number.

To use the present invention in accordance with a preferred embodiment of the present invention, as shown in the figures, and especially FIG. 4, a standard ceiling or recirculation fan 40 is mounted to the recirculation fan portable mounting apparatus 1 by standard and conventional mounting with screws, utilizing any of the various mounting holes 18. The power cord 41 is then threaded through the central aperture 14 (not shown). The mounting apparatus is then affixed to any available support member 20 in the manner described above in FIGS. 2 and 3, and the power cord 41 plugged into any available standard outlet.

The user now has mounted a standard ceiling fan to provide cooling and circulation in a portable and easily movable manner.

The foregoing description of the preferred embodiment of the present invention has been presented for purposes of illustration and description. It is not intended to be exhaustive or to limit the present invention to the precise form disclosed, and obviously many modifications and variations are possible in light of the above teachings. The scope of the invention is to be limited only by the following claims.

What is claimed is:

1. A fan mounting apparatus, said fan mounting apparatus being portable and removable, said fan mounting apparatus comprising:

a generally flat mounting plate having an upper surface and a lower surface;

a central aperture penetrating said mounting plate between said upper surface and said lower surface;

a first grasping hook mounted to said upper surface at a plane offset from the centerline of said mounting plate and having a first vertical wall connected to and protruding from said upper surface and a first horizontal tongue protruding parallel to said upper surface;

a first threaded bolt hole penetrating said mounting plate and aligned directly beneath said first horizontal tongue;

a first bolt for threadingly engaging said first bolt hole such as to penetrate from said lower surface, past said upper surface;

a second grasping hook mounted to said upper surface at a plane offset from the centerline of said mounting plate and having a second vertical wall connected to and protruding from said upper surface and a second horizontal tongue protruding parallel to said upper surface;

a second threaded bolt hole penetrating said mounting plate and aligned directly beneath said second horizontal tongue;

a second bolt for threadingly engaging said second bolt hole such as to penetrate from said lower surface, past said upper surface; and second connection means for affixing a ceiling-type circulation fan to said lower surface.

2. The fan mounting apparatus as described in claim 1, wherein said first grasping hook and said second grasping hook are symmetrically opposed such that both said first horizontal tongue and said second horizontal tongue each point both opposite and inward toward the centerline of said mounting plate.

3. In a fan mounting apparatus having a mounting plate and a connection means for connecting to a ceiling-type fan, wherein the improvement comprises a portable attachment means for removably mounting said ceiling-type fan to a narrow support surface, and wherein said mounting plate has an upper surface and a lower surface, and wherein the portable attachment means comprises:

a first grasping hook mounted to said upper surface at a plane offset from the centerline of said mounting plate and having a first vertical wall connected to and protruding from said upper surface and a first horizontal tongue protruding parallel to said upper surface;

a first threaded bolt hole penetrating said mounting plate and aligned directly beneath said first horizontal tongue;

a first bolt for threadingly engaging said first bolt hole such as to penetrate from said lower surface, past said upper surface;

a second grasping hook mounted to said upper surface at a plane offset from the centerline of said mounting plate and having a second vertical wall connected to and protruding from said upper surface and a second horizontal tongue protruding parallel to said upper surface;

a second threaded bolt hole penetrating said mounting plate and aligned directly beneath said second horizontal tongue; and a second bolt for threadingly engaging said second bolt hole such as to penetrate from said lower surface, past said upper surface.

4. The fan mounting apparatus as described in claim 3, wherein said first grasping hook and said second grasping hook are symmetrically opposed such that both said first horizontal tongue and said second horizontal tongue each point both opposite and inward toward the centerline of said mounting plate.

* * * * *